US005987657A

United States Patent [19]

Byers

[11] Patent Number: 5,987,657

[45] Date of Patent: Nov. 23, 1999

[54] TOILET ATTACHMENT AND AID

[76] Inventor: Melvin A. Byers, 238 Parkville Ave., Brooklyn, N.Y. 11230

[21] Appl. No.: 09/140,850

[22] Filed: Aug. 27, 1998

[51] Int. Cl.[6] ..... E03D 11/00

[52] U.S. Cl. ..... 4/254

[58] Field of Search ..... 4/254, 667, DIG. 5, 4/483; D23/296, 297, 310

[56] References Cited

U.S. PATENT DOCUMENTS

| | | | |
|---|---|---|---|
| 3,657,745 | 4/1972 | Hickman | 4/254 X |
| 4,713,846 | 12/1987 | Hodroski | 4/254 |

FOREIGN PATENT DOCUMENTS

| | | | |
|---|---|---|---|
| 0842422 | 6/1939 | France | 4/254 |
| 1549881 | 8/1979 | United Kingdom | 4/254 |

*Primary Examiner*—Charles E. Phillips

[57] ABSTRACT

A new TOILET ATTACHMENT AND AID for MAKING USE OF A TOILET EASIER FOR ELDERLY AND INFIRMED PERSONS. The inventive device includes a curved main portion dimensioned for straddling and conforming to a front portion of a toilet bowl. The curved main portion has an upper edge, a lower edge and opposed side edges. A pair of footrests are integrally formed with the opposed side edges of the curved main portion. A urine guard is integrally formed with the upper edge of the curved main portion.

14 Claims, 2 Drawing Sheets

TOILET ATTACHMENT AND AID

BACKGROUND OF THE INVENTION

1. Field of the Invention

The present invention relates to TOILET ATTACHMENTS and more particularly pertains to a new TOILET ATTACHMENT AND AID for MAKING USE OF A TOILET EASIER FOR ELDERLY AND INFIRMED PERSONS.

2. Description of the Prior Art

The use of TOILET ATTACHMENTS is known in the prior art. More specifically, TOILET ATTACHMENTS heretofore devised and utilized are known to consist basically of familiar, expected and obvious structural configurations, notwithstanding the myriad of designs encompassed by the crowded prior art which have been developed for the fulfillment of countless objectives and requirements.

Known prior art TOILET ATTACHMENTS include U.S. Pat. No. 4,254,514 to Sakamoto; U.S. Pat. No. 4,012,797 to Kristoffersen; U.S. Pat. No. Des. 353,659 to Hall; U.S. Pat. No. 4,979,240 to Welles; U.S. Pat. No. 5,028,024 to Welles; and U.S. Pat. No. 4,584,725 to Oliver.

While these devices fulfill their respective, particular objectives and requirements, the aforementioned patents do not disclose a new TOILET ATTACHMENT AND AID. The inventive device includes a curved main portion dimensioned for straddling and conforming to a front portion of a toilet bowl. The curved main portion has an upper edge, a lower edge and opposed side edges. A pair of footrests are integrally formed with the opposed side edges of the curved main portion. A urine guard is integrally formed with the upper edge of the curved main portion.

In these respects, the TOILET ATTACHMENT AND AID according to the present invention substantially departs from the conventional concepts and designs of the prior art, and in so doing provides an apparatus primarily developed for the purpose of MAKING USE OF A TOILET EASIER FOR ELDERLY AND INFIRMED PERSONS.

SUMMARY OF THE INVENTION

In view of the foregoing disadvantages inherent in the known types of TOILET ATTACHMENTS now present in the prior art, the present invention provides a new TOILET ATTACHMENT AND AID construction wherein the same can be utilized for MAKING USE OF A TOILET EASIER FOR ELDERLY AND INFIRMED PERSONS.

The general purpose of the present invention, which will be described subsequently in greater detail, is to provide a new TOILET ATTACHMENT AND AID apparatus and method which has many of the advantages of the TOILET ATTACHMENTS mentioned heretofore and many novel features that result in a new TOILET ATTACHMENT AND AID which is not anticipated, rendered obvious, suggested, or even implied by any of the prior art TOILET ATTACHMENTS, either alone or in any combination thereof.

To attain this, the present invention generally comprises a curved main portion dimensioned for straddling and conforming to a front portion of a toilet bowl. The curved main portion has an upper edge, a lower edge and opposed side edges. The curved main portion has a height essentially equal to a height of the toilet bowl. A pair of footrests are integrally formed with the opposed side edges of the curved main portion. The foot rests each have a curved outer wall and a planar upper surface. The planar upper surface of each footrest is dimensioned for supporting a foot thereon. The planar upper surface of each of the footrests have a strip of abrasive material disposed thereon. A urine guard is integrally formed with the upper edge of the curved main portion. The urine guard comprises an upper portion and a lower portion. The upper portion extends in an essentially linear arrangement. The upper portion terminates in an inwardly curved member. The lower portion has an essentially horizontal portion paralleling a rim of the toilet bowl. The lower portion has a vertical channeling portion extending downwardly from the horizontal portion to an interior of the toilet bowl. A toilet seat is pivotally coupled with the toilet bowl. The toilet seat has a generally circular configuration with a central aperture and with a separation at a forward point thereof. A lid is pivotally coupled with the toilet bowl and disposed over the toilet seat. The lid has a generally circular configuration with a radially extending aperture at a forward point thereof in alignment with the separation of the toilet seat.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new TOILET ATTACHMENT AND AID apparatus and method which has many of the advantages of the TOILET ATTACHMENTS mentioned heretofore and many novel features that result in a new TOILET ATTACHMENT AND AID which is not anticipated, rendered obvious, suggested, or even implied by any of the prior art TOILET ATTACHMENTS, either alone or in any combination thereof.

It is another object of the present invention to provide a new TOILET ATTACHMENT AND AID which may be easily and efficiently manufactured and marketed.

It is a further object of the present invention to provide a new TOILET ATTACHMENT AND AID which is of a durable and reliable construction.

An even further object of the present invention is to provide a new TOILET ATTACHMENT AND AID which is susceptible of a low cost of manufacture with regard to both materials and labor, and which accordingly is then susceptible of low prices of sale to the consuming public, thereby making such TOILET ATTACHMENT AND AID economically available to the buying public.

Still yet another object of the present invention is to provide a new TOILET ATTACHMENT AND AID which provides in the apparatuses and methods of the prior art some of the advantages thereof, while simultaneously overcoming some of the disadvantages normally associated therewith.

Still another object of the present invention is to provide a new TOILET ATTACHMENT AND AID for MAKING USE OF A TOILET EASIER FOR ELDERLY AND INFIRMED PERSONS.

Yet another object of the present invention is to provide a new TOILET ATTACHMENT AND AID which includes a curved main portion dimensioned for straddling and conforming to a front portion of a toilet bowl. The curved main portion has an upper edge, a lower edge and opposed side edges. A pair of footrests are integrally formed with the opposed side edges of the curved main portion. A urine guard is integrally formed with the upper edge of the curved main portion.

Still yet another object of the present invention is to provide a new TOILET ATTACHMENT AND AID that would make a toilet easier to use for people afflicted with hemorrhoids or other afflictions.

Even still another object of the present invention is to provide a new TOILET ATTACHMENT AND AID that prevents urine from exiting the toilet bowl.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
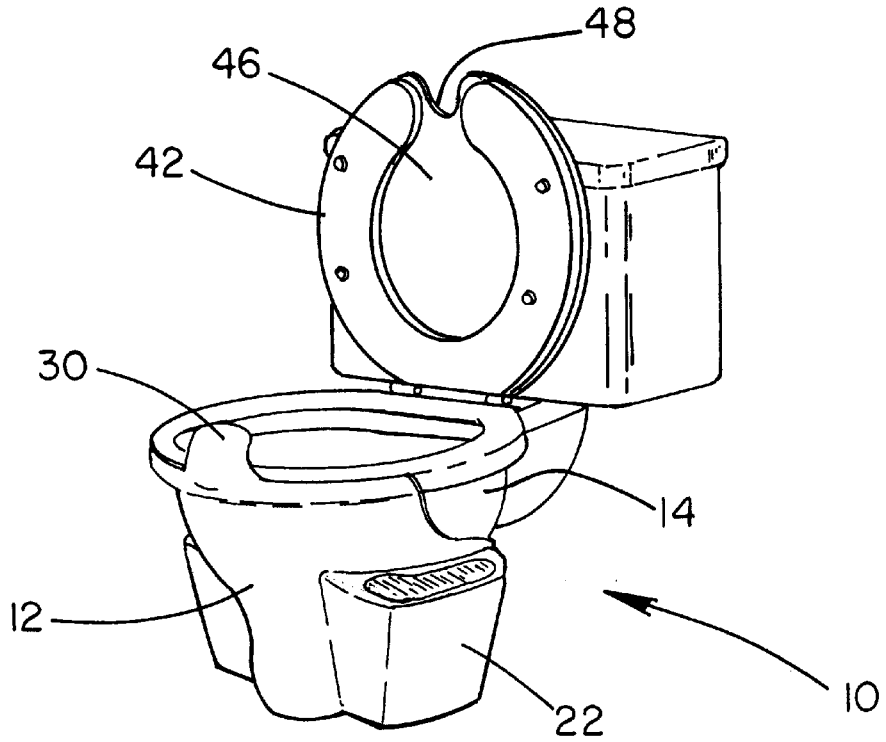
FIG. 1 is a perspective view of a new TOILET ATTACHMENT AND AID according to the present invention.
Figure 2:
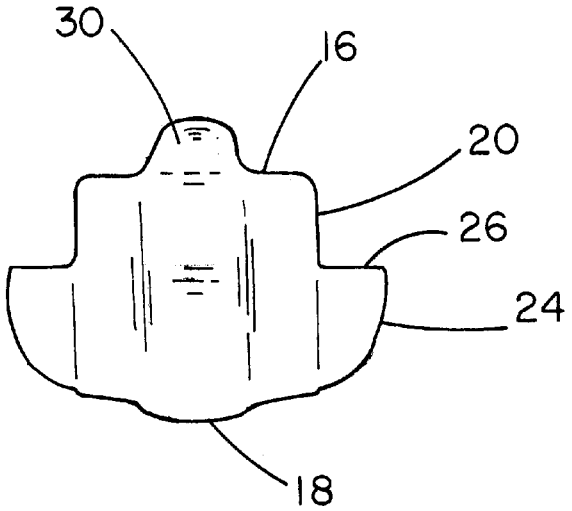
FIG. 2 is a front elevation view of the present invention.
Figure 3:
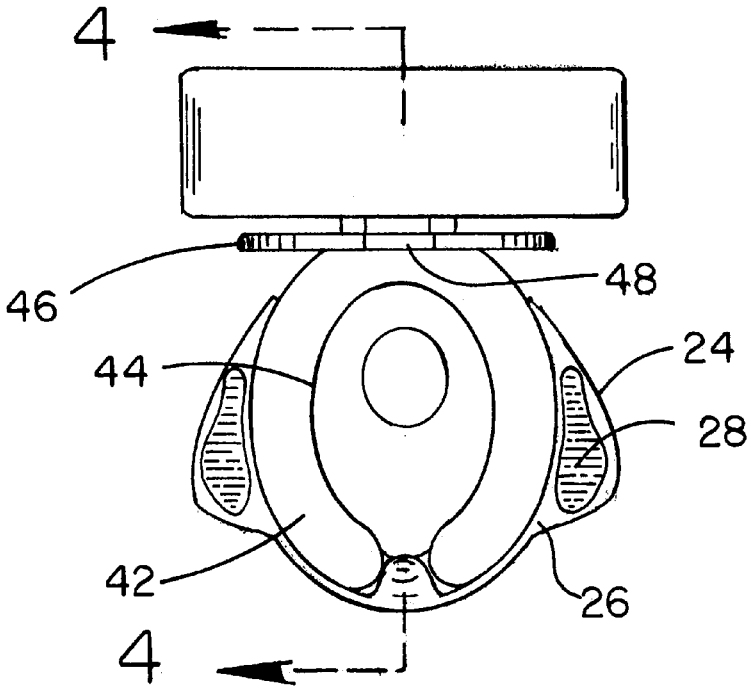
FIG. 3 is a top plan view of the present invention.
Figure 4:
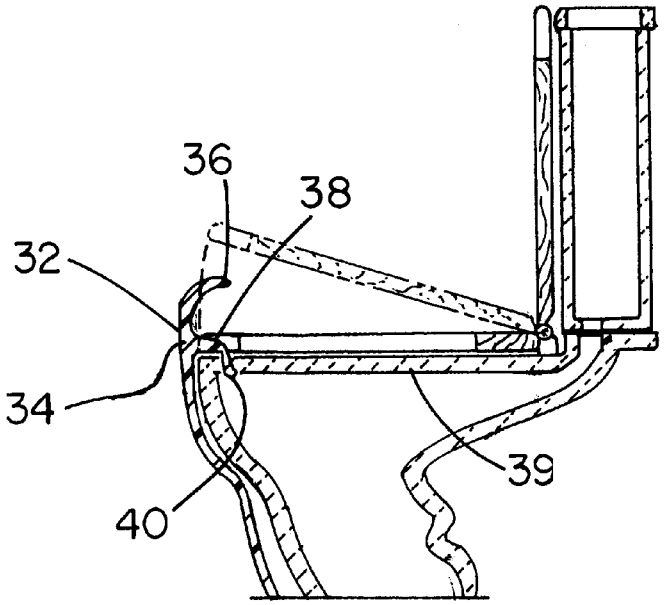
FIG. 4 is a cross-sectional view of the present invention as taken along line 4—4 of FIG. 3.

With reference now to the drawings, and in particular to FIGS. 1 through 4 thereof, a new TOILET ATTACHMENT AND AID embodying the principles and concepts of the present invention and generally designated by the reference numeral 10 will be described.

As best illustrated in FIGS. 1 through 4, the TOILET ATTACHMENT AND AID 10 comprises a curved main portion 12 dimensioned for straddling and conforming to a front portion of a toilet bowl 14. The curved main portion 12 is preferably fabricated of a rigid plastic and measure approximately twenty-four inches in height and twelve inches in width. The curved main portion 12 has an upper edge 16, a lower edge 18 and opposed side edges 20. The curved main portion 12 has a height essentially equal to a height of the toilet bowl 14.

A pair of footrests 22 are integrally formed with the opposed side edges 20 of the curved main portion 12. The foot rests 22 each have a curved outer wall 24 and a planar upper surface 26. The planar upper surface 26 of each footrest 22 is dimensioned for supporting a foot thereon. The planar upper surface 26 of each of the footrests 22 has a strip of abrasive material 28 disposed thereon.

A urine guard 30 is integrally formed with the upper edge 16 of the curved main portion 12. The urine guard 30 comprises an upper portion 32 and a lower portion 34. The upper portion 32 extends in an essentially linear arrangement. The upper portion 32 terminates in an inwardly curved member 36. The lower portion 34 has an essentially horizontal portion 38 paralleling a rim 39 of the toilet bowl 14. The lower portion 34 has a vertical channeling portion 40 extending downwardly from the horizontal portion 38 to an interior of the toilet bowl 14.

A toilet seat 42 is pivotally coupled with the toilet bowl 14. The toilet seat 42 has a generally circular configuration with a central aperture 44 and with a separation at a forward point thereof.

A lid 46 is pivotally coupled with the toilet bowl 14 and disposed over the toilet seat 42. The lid 46 has a generally circular configuration with a radially extending aperture 48 at a forward point thereof in alignment with the separation of the toilet seat 42.

In use, the person using the toilet would be squatting rather than sitting, thus easing the process of defecation. This device 10 would provide a person who suffers from hemorrhoids or a similar affliction with a way to use the toilet in a squatting position, thus easing the process of using the toilet. The user simply positions their feet upon the foot rests 22 thereby allowing them to assume the squatting position instead of being required to sit on the toilet in the usual manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet attachment and aid for making use of a toilet easier for elderly and affirmed persons comprising, in combination:

a curved main portion dimensioned for straddling and conforming to a front portion of a toilet bowl, the curved main portion having an upper edge, a lower edge and opposed side edges, the curved main portion having a height essentially equal to a height of the toilet bowl;

a pair of foot rests integrally formed with the opposed side edges of the curved main portion, the foot rests each having a curved outer wall and a planar upper surface, the planar upper surface of each foot rest dimensioned for supporting a foot thereon, the planar upper surface of each of the foot rests having a strip of abrasive material disposed thereon;

a urine guard integrally formed with the upper edge of the curved main portion, the urine guard comprising an upper portion and a lower portion, the upper portion extending in an essentially linear arrangement, the upper portion terminating in an inwardly curved member, the lower portion having an essentially horizontal portion paralleling a rim of the toilet bowl, the lower portion having a vertical channeling portion extending downwardly from the horizontal portion to an interior of the toilet bowl;

a toilet seat pivotally coupled with the toilet bowl, the toilet seat having a generally circular configuration with a central aperture and with a separation at a forward point thereof; and a lid pivotally coupled with the toilet bowl and disposed over the toilet seat, the lid having a generally circular configuration with a radially extending aperture at a forward point thereof in alignment with the separation of the toilet seat.

2. A toilet attachment and aid comprising:

a curved main portion dimensioned for straddling and conforming to a front portion of a toilet bowl, the curved main portion having an upper edge, a lower edge and opposed side edges;

a pair of foot rests integrally formed with the opposed side edges of the curved main portion;

a urine guard integrally formed with the upper edge of the curved main portion;

wherein the urine guard comprises an upper portion and a lower portion, the upper portion extending in an essentially linear arrangement;

wherein the upper portion terminates in an inwardly curved member; and wherein the lower portion of the urine guard has an essentially horizontal portion paralleling a rim of the toilet bowl, the lower portion has a vertical channeling portion extending downwardly from the horizontal portion to an interior of the toilet bowl.

3. The toilet attachment and aid as set forth in claim 2 wherein the curved main portion has a height essentially equal to a height of the toilet bowl.

4. The toilet attachment and aid as set forth in claim 2 wherein the foot rests each have a curved outer wall and a planar upper surface, the planar upper surface of each foot rest dimensioned for supporting a foot thereon.

5. The toilet attachment and aid as set forth in claim 4 wherein the planar upper surface of each of the foot rests have a strip of abrasive material disposed thereon.

6. The toilet attachment and aid as set forth in claim 2 and further including a toilet seat pivotally coupled with the toilet bowl, the toilet seat having a generally circular configuration with a central aperture and with a separation at a forward point thereof.

7. The toilet attachment and aid as set forth in claim 6 and further including a lid pivotally coupled with the toilet bowl and disposed over the toilet seat, the lid having a generally circular configuration with a radially extending aperture at a forward point thereof in alignment with the separation of the toilet seat.

8. A toilet attachment and aid comprising:

a curved main portion dimensioned for straddling and conforming to a front portion of a toilet bowl, the curved main portion having an upper edge, a lower edge and opposed side edges;

a pair of foot rests integrally formed with the opposed side edges of the curved main portion;

a urine guard integrally formed with the upper edge of the curved main portion;

a toilet seat pivotally coupled with the toilet bowl, the toilet seat having a generally circular configuration with a central aperture and with a separation at a forward point thereof; and a lid pivotally coupled with the toilet bowl and disposed over the toilet seat, the lid having a generally circular configuration with a radially extending aperture at a forward point thereof in alignment with the separation of the toilet seat.

9. The toilet attachment and aid as set forth in claim 8 wherein the curved main portion has a height essentially equal to a height of the toilet bowl.

10. The toilet attachment and aid as set forth in claim 8 wherein the foot rests each have a curved outer wall and a planar upper surface, the planar upper surface of each foot rest dimensioned for supporting a foot thereon.

11. The toilet attachment and aid as set forth in claim 10 wherein the planar upper surface of each of the foot rests have a strip of abrasive material disposed thereon.

12. The toilet attachment and aid as set forth in claim 8 wherein the urine guard comprises an upper portion and a lower portion, the upper portion extending in an essentially linear arrangement.

13. The toilet attachment and aid as set forth in claim 12 wherein the upper portion terminates in an inwardly curved member.

14. The toilet attachment and aid as set forth in claim 13 wherein the lower portion of the urine guard has an essentially horizontal portion paralleling a rim of the toilet bowl, the lower portion has a vertical channeling portion extending downwardly from the horizontal portion to an interior of the toilet bowl.

* * * * *